United States Patent [19]

Anderson

[11] 4,180,963

[45] Jan. 1, 1980

[54] ADJUSTABLE ROPE HALTER AND KIT FOR ASSEMBLING THE SAME

[76] Inventor: Robert P. Anderson, 2800 S. University Blvd., #168, Denver, Colo. 80210

[21] Appl. No.: 894,353

[22] Filed: Apr. 7, 1978

[51] Int. Cl.[2] ..... B68B 1/02

[52] U.S. Cl. ..... 54/24

[58] Field of Search ..... 54/24, 6 R

[56] References Cited

U.S. PATENT DOCUMENTS

| | | | |
|---|---|---|---|
| 1,747,012 | 2/1930 | Johnson | 54/24 |
| 1,939,107 | 12/1933 | Crandall | 54/24 |
| 2,114,178 | 4/1938 | Crandall | 54/24 |
| 3,418,787 | 12/1968 | Smith | 54/24 |

*Primary Examiner*—Hugh R. Chamblee

*Attorney, Agent, or Firm*—Ralph F. Crandell

[57] ABSTRACT

An adjustable rope halter for horses and a kit for assembling the halter. The halter is formed from a single length of rope shaped to form a headstall having a headband loop releasably engageable with a clasp. A noseband is defined by upper and lower nose loops and a lower jaw loop is engaged with a halter ring on the lower nose loop. The clasp is engageable with the headband for mounting the halter on a horse's head when the noseband is engaged with the horse's nose and the headband is passed around the back of the horse's head.

2 Claims, 12 Drawing Figures

ADJUSTABLE ROPE HALTER AND KIT FOR ASSEMBLING THE SAME

FIELD AND BACKGROUND OF THE INVENTION

The present invention relates to a rope halter for horses and more particularly to an adjustable rope halter and a kit for assembling the same.

Rope halters are conventionally formed and constructed by tying, splicing or buckling sections of rope together, utilizing permanent splices or connections to provide a single size halter or headstall.

OBJECTS AND SUMMARY OF THE INVENTION

It is the principal object of the present invention to provide an improved rope halter or headstall.

A more specific object is to provide an improved rope halter or headstall which can be readily and easily assembled and which is adjustable according to the size of the horse or colt on which it is to be used.

A further object of the present invention is to provide a kit or package from which a rope halter can be readily and quickly assembled.

Another object of the present invention is to provide improved fittings for use with a single, continuous rope in order to form a halter.

In accordance with the foregoing objects, the present invention contemplates a halter in kit or assembled form comprising a single continuous rope forming a headstall having a headband releasably engageable around a horse's head and a noseband for positioning about the horse's nose. The halter is formed from a single continuous length of rope, four keepers and a clasp member. The halter is formed from the rope and keepers with the rope having an end portion engaged with a pair of spaced keepers to define an upper nose loop, a continuing portion of said rope extending from said upper nose loop and being engaged with another keeper to form a head loop releasably engageable with a clasp. A continuing portion of the rope extends from the head loop and is engaged with still another keeper to form a lower jaw loop, the lower jaw loop extending through a ring, and with a continuing portion extending therefrom into engagement with the clasp. A portion of the rope extending from the clasp through the first mentioned pair of keepers forms a lower nose loop which also extends through the ring. The rope is slideably adjustable with respect to the keepers and clasp so that the halter can be sized to fit the desired horse.

The halter is designed to be packaged either in kit form with the rope and keepers and clasp separated and appropriate instructions for assembly, or for packaging and sale in an assembled form. The halter is readily sized and adjusted to fit a particular horse.

DESCRIPTION OF THE PREFERRED EMBODIMENT

Figure 1:
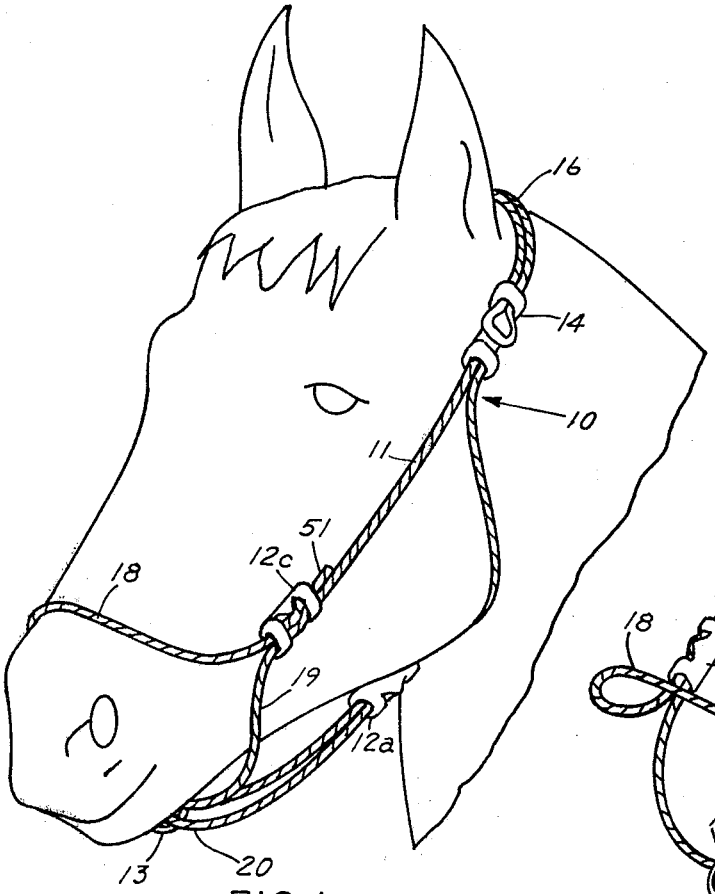
FIG. 1 is a perspective view of a halter embodying the present invention, positioned on a horse's head.

A rope halter or headstall embodying the present invention is shown in detail in the drawings. In FIG. 1, the halter is shown assembled and mounted on a horse's head. A halter in this configuration is illustrated in more detail in FIGS. 2, 3, 4 and 5. The halter is uniquely suitable for assembly from a kit, the kit components being shown in FIG. 8 with the sequential assembly steps being shown in FIGS. 9, 10, 11 and 12.

The halter or headstall 10 embodying the invention is formed from a single length of rope 11 by utilizing four keepers 12, a brass ring 13, and a clasp 14. The rope is shaped into the various sections and held together by the keepers 12 and clasp 14 to form a headstall or halter having a headband 16 which extends around the back of the horse's head and engages the clasp 14, and an upper nose loop 18 and lower nose loop 19, which together form a nose loop which slips over the front of the horse's nose. A lower jaw loop 20 is connected to the lower nose loop 19 by the brass ring 13 and is adapted to extend under the horse's jaw when the nose loop is positioned over the horse's nose and the head loop extends around the back of the horse's head into engagement with the clasp 14. Because the halter is formed from a single continuous length of rope, the end portions of the various components, that is, the upper and lower nose loops, the headband and lower jaw loop, are continuous with corresponding ends of other components. This is an important feature, since it enables the halter to be readily formed in larger or smaller sizes according to the size of the horse for which it is adapted. Provided that the rope ends have not been cut off, as the horse grows, it is possible to enlarge the halter simply by making adjustments in the position of the various keepers 12 and clasp 14. Where the horse or colt is small, it may be desirable to utilize additional keepers (not shown) to retain the extra length of the free ends of the rope 11.

Before describing the halter assembly and construction in detail, it will be helpful to consider first the keepers 12 and clasp 14. These members are formed of a rigid plastic material such as nylon and are provided with smoothly rounded surfaces and edges to preclude cutting or tearing of the rope. The keepers 12 are formed with an elongated rectangular base 22 having at each end an oval-shaped tubular section 24 defining an oval-shaped passage 25 dimensioned to snugly enclose two side-by-side strand portions of the rope 11. Intermediate the two cylindrical portions, the base includes a central transverse ridge 26 of a height approximately equal to the narrow dimension of the oval passages 25. The side walls 28 of the ridge 26 slope arcuately upwardly from a point on the base 22 adjacent the tubular sections 24 to a smoothly rounded peak of the ridge 26. Referring to FIGS. 1 through 4, when a strand of the rope is passed through the tubular end sections 24 and up over the ridge 26, the ridge in cooperation with the end sections frictionally holds the rope strand. The harder the pull on the rope, the tighter the engagement with the keeper 12 becomes as the tension on the rope strand causes the ridge to frictionally engage the rope in a transverse direction.

Figure 2:
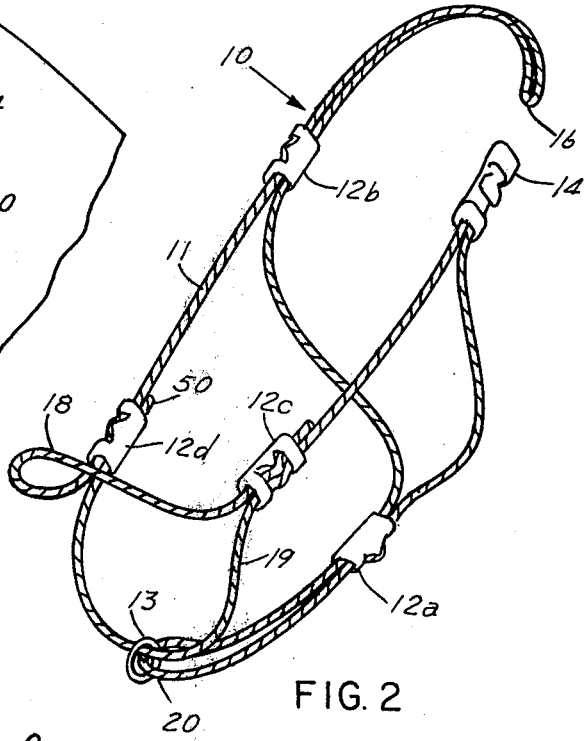
FIG. 2 is a perspective view of a halter embodying the present invention in a configuration suitable for positioning on a horse's head.
Figure 3:
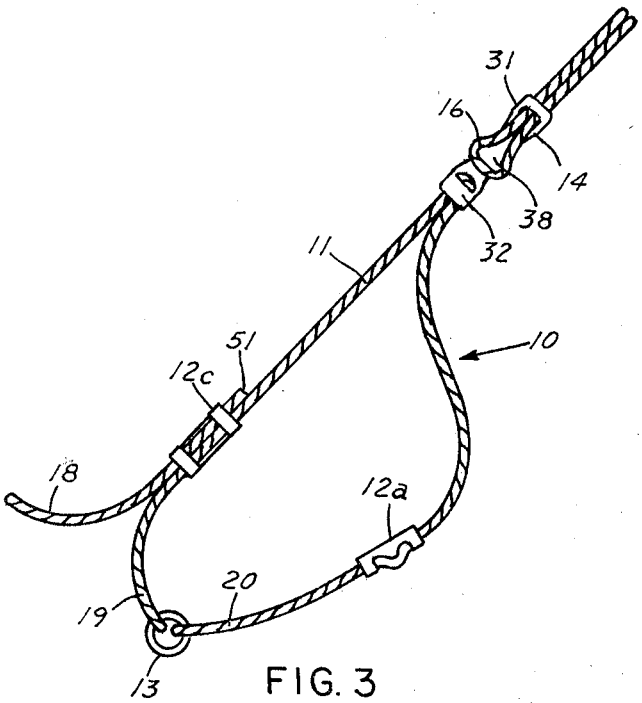
FIG. 3 is a side elevation view of the halter shown in FIG. 2 but with the halter clasp engaged.
Figure 4:
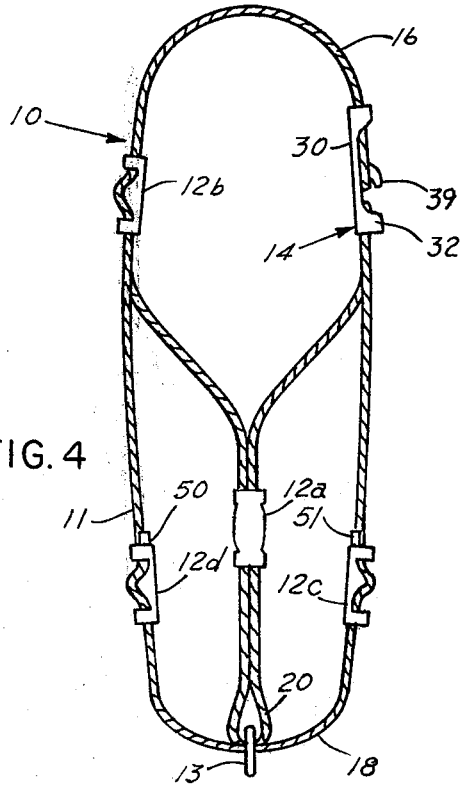
FIG. 4 is a top plan view of the halter shown in FIG. 3.
Figure 5:
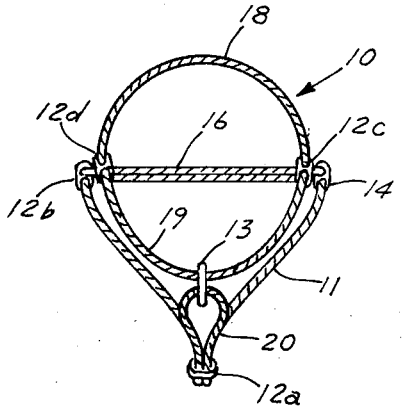
FIG. 5 is a front elevation view of the halter shown in FIG. 3.
Figure 6:
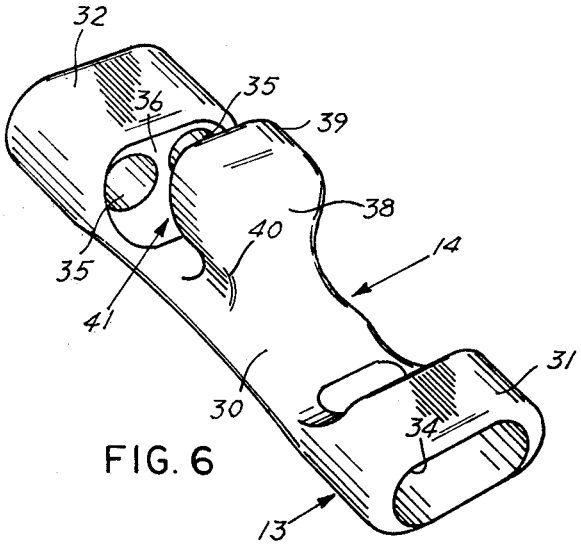
FIG. 6 is an enlarged perspective view of a clasp utilized on the halter shown in FIG. 1.
Figure 7:
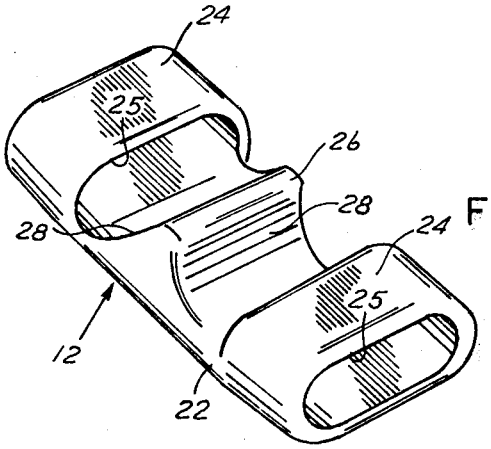
FIG. 7 is an enlarged perspective view of a keeper utilized in forming the halter shown in FIG. 1.

The clasp 14 is likewise formed with an elongated rectangular base 30 having at each end an oval-shaped tubular section 31, 32, the first such section defining an oval-shaped passage 34 while the second such tubular section 32 defines a pair of side-by-side cylindrical passages 35 with a wall or web 36 between them. Intermediate the tubular sections 31, 32, is an inclined tongue 38 sloping towards the second tubular section 32 and defining an enlarged rounded end portion 39 and concave side portions 40. The clasp is constructed so as to receive a loop of rope through the oval-shaped passage 34 in the tubular end section 31 which is in turn looped around and over the tongue 38 and into the slot 41 defined between the tongue end 39 and the second tubular section 32. The loop of rope, as shown in FIG. 1, is prevented from slipping off of the tongue as it nests in the concave side slots 40. The clasp is secured to the rope by passing the rope through one opening 35 and back through the other to form a loop which is retained in place by the intermediate web 36 as shown in FIGS. 2 and 3.

The halter embodying the present invention is constructed by utilizing a simple but unique procedure. For most animals the length of rope utilized is approximately 10 feet. It has been determined that certain construction dimensions, if followed, and based on the 10 foot rope length, will produce a halter sized for a foal, weanling, yearling, two year old or adult. These dimensions are given in inches in Table 1.

TABLE I

| Dimension | Foal | Weanling | Yearling | 2 Year Old | Adult |
|---|---|---|---|---|---|
| A | 12 | 14 | 16 | 18 | 20 |
| B | 10 | 11½ | 13 | 14½ | 16 |
| C | 3½ | 4 | 4½ | 5 | 5½ |
| D | 5½ | 6 | 6½ | 7 | 7½ |
| E | 7½ | 9 | 10½ | 12 | 13½ |
| F | 9½ | 11 | 12½ | 14 | 15½ |
| G | 6½ | 8 | 9 | 10 | 11½ |

Minor adjustments may be made according to the particular size of the animal for which the halter is constructed. As the animal grows, the halter may be enlarged.

Figure 8:
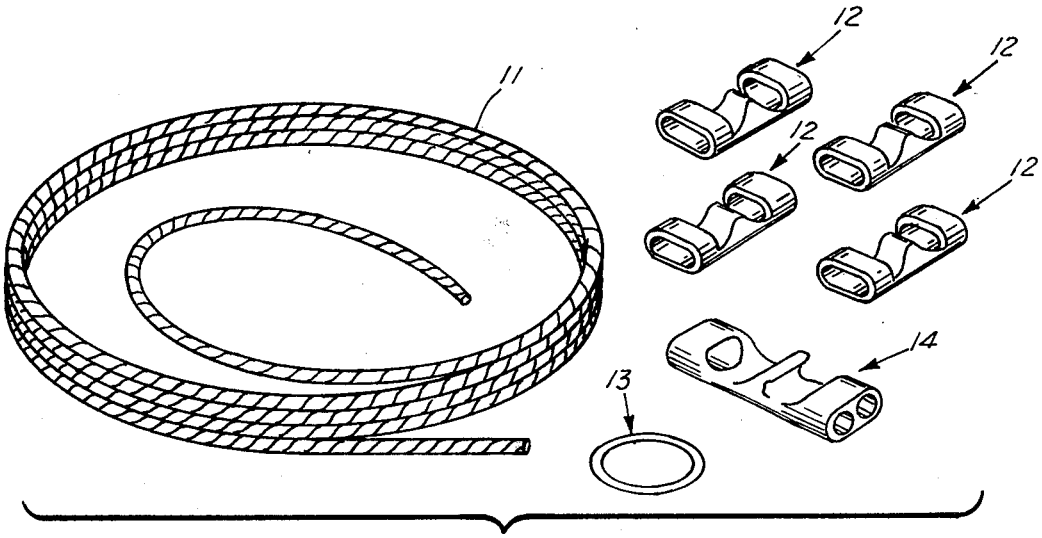
FIG. 8 is a perspective view of a kit for forming a halter shown in FIG. 1 and including a single continuous length of rope, four keepers of the character shown in FIG. 7, a clasp of the character shown in FIG. 6 and a halter ring.
Figure 9:
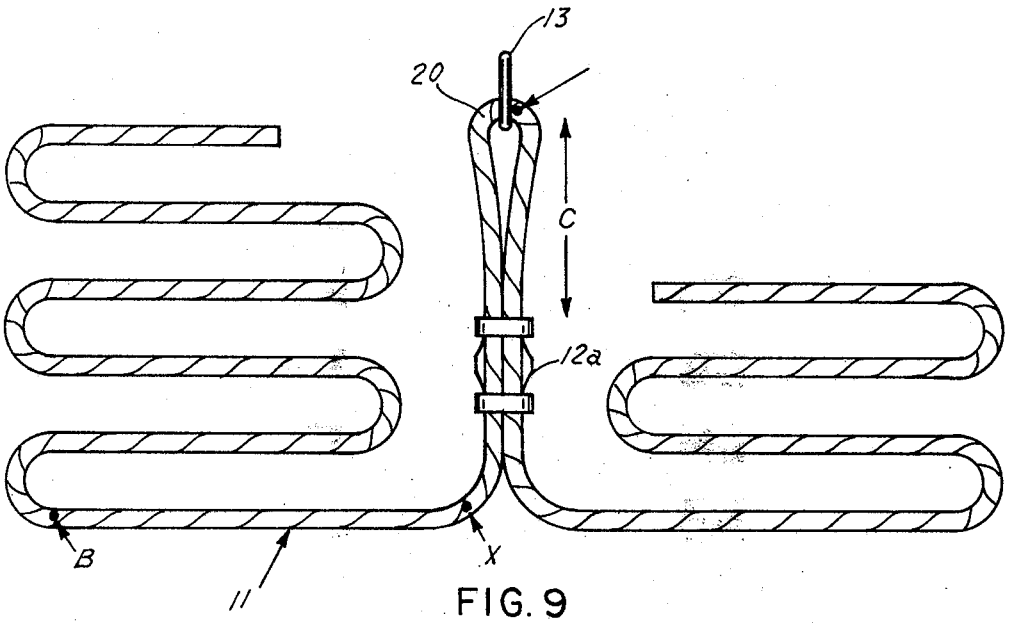
FIG. 9 is a plan view of a halter in a first stage of assembly.

Referring to FIGS. 9 through 12, and Table I, in order to assemble a halter from the kit shown in FIGS. 8, the length of rope 11 is doubled and its center X marked with a crayon or pen. Dimension A from Table I is marked on one side of the Center X and dimension B on the other side of the center X. The brass ring 13 is placed at point A with the shorter end of the rope to the right as shown in FIG. 9. Both ends are threaded through a keeper **12*a* leaving a loop containing the ring with the ring a distance C from the keeper 12*a***.

Figure 10:
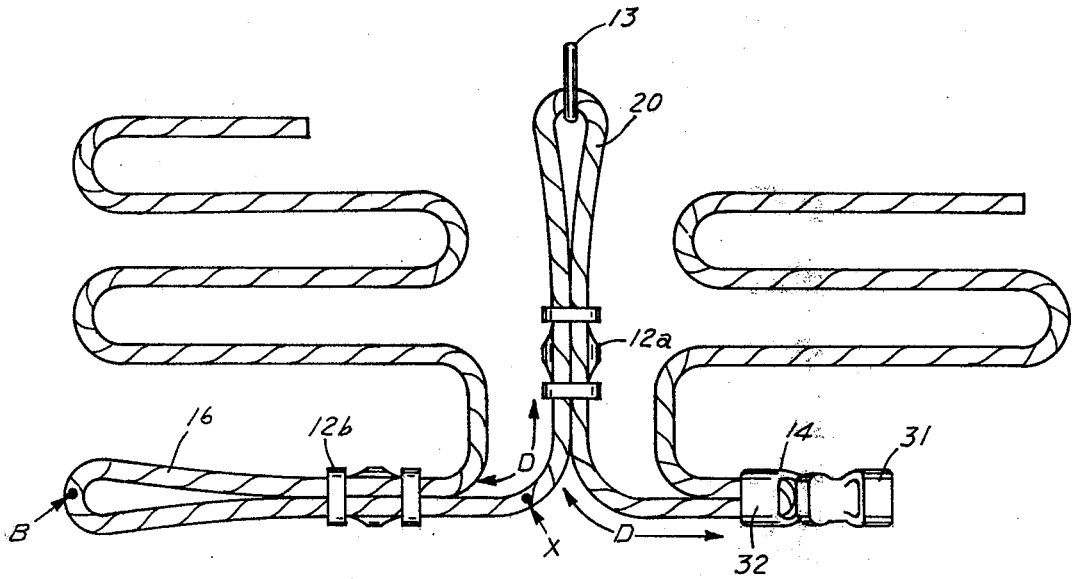
FIG. 10 is a plan view of a halter in a second stage of assembly.

The short end of the rope is then threaded through the cylindrical openings at 35 and around the web 36 in the tubular portion 32 of the clasp 14 leaving a distance of dimension D between the clasp and keeper 12, as shown in FIG. 10. The longer end of the rope is then looped at mark B and the loop threaded through a second keeper **12*b*, also as shown in FIG. 10, with a distance D between the keepers 12*a* and 12*b***.

Figure 11:
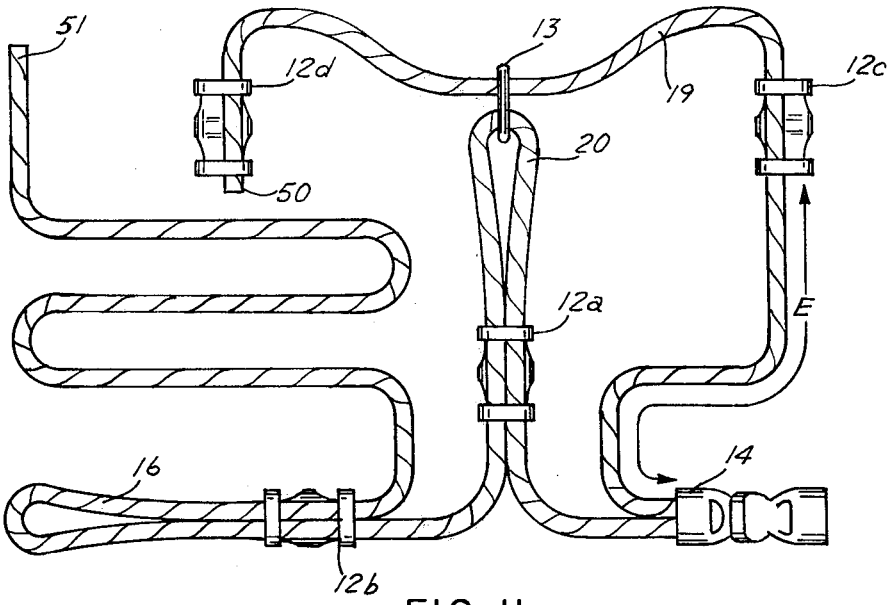
FIG. 11 is a plan view of a halter in a third stage of assembly.
Figure 12:
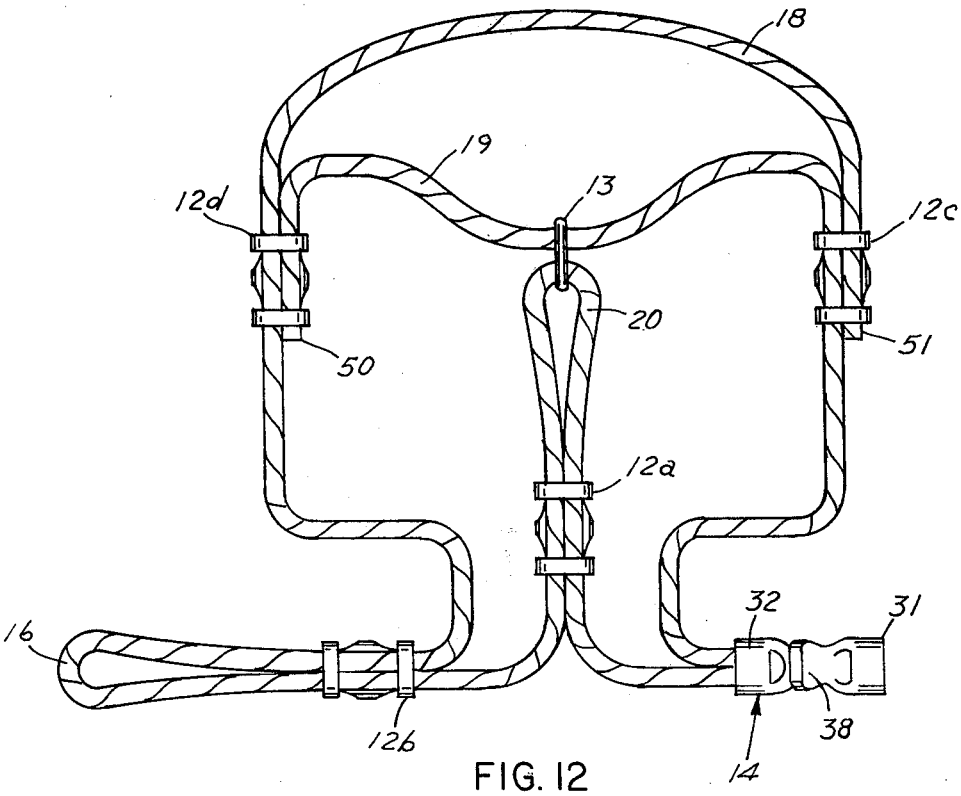
FIG. 12 is a plan view of a halter in a fourth or final stage of assembly and ready for shaping into the form shown in FIG. 2 for placement on a horse's head.

The shorter end of the rope extending from the clasp 14 is then threaded through a third keeper **12*c* leaving a distance E between the clasp 14 and keeper 12*c* as shown in FIG. 11. The end extending from keeper 12*c* is then threaded through the brass ring 13 and through a fourth keeper 12*d* with the free end of the rope 50 extending just through the keeper 12*d* as shown in FIG. 11. The remaining free end 51 of the rope is then threaded through keeper 12*d* and thence through keeper 12*c* as shown in FIG. 12, with the free end 51 of the rope extending just outside the keeper 12*c*. This completes the halter assembly and the entire halter can then be shaped as shown in FIG. 2** for use on a horse.

Referring to FIG. 12 it will be noted that the above formed halter includes a head loop or headstall 16 which is engageable with the tongue 38 of the clasp 14 when the loop 16 is passed through the first tubular section 31 of the clasp 14. The halter further includes a lower jaw loop 20 engaged through the brass ring 13 on the lower nose loop 19. An upper nose loop 18 is defined above the lower nose loop with the ends of the upper and lower nose loops being held together by the keepers **12*c* and 12*d***.

The halter thus formed, being constructed from a single length of rope, is readily adapted for adjustment and sizing so as to fit on a particular horse. This can be accomplished by adjusting the length of the headstall or head loop 16, the distances between the various keepers and the size of the nose loops 18 and 19. The halter embodying the present invention is thus admirally suited for construction from a kit or may be pre-assembled.

While a certain illustrative embodiment of the present invention has been shown in the drawings and described above in considerable detail, it should be understood that there is no intention to limit the invention to the specific form disclosed. On the contrary, the intention is to cover all modifications, alternative constructions, equivalents and uses falling within the spirit and scope of the invention as expressed in the appended claims.

I claim as my invention:

1. A halter comprising a single continuous length of rope forming a headstall having a headband releasably engageable with a horse's head and a noseband for positioning about the horse's nose, said halter comprising a single continuous rope having an end portion engaged with a pair of spaced keepers to define an upper nose loop, a continuing portion of said rope extending from said upper nose loop and being looped back on itself and engaged with another keeper to form a headband loop, said headband loop being adapted to be releasably engageable with a clasp, a continuing portion of said rope extending from said headband loop being looped back on itself and engaged with still another keeper to form a lower jaw loop, said lower jaw loop being engaged through a ring, a continuing portion of said rope extending from said lower jaw loop into engagement with said clasp, and a further continuing portion of said rope extending from said clasp through said first mentioned pair of keepers to form a lower nose loop with said lower nose loop extending through said ring, said rope being slideably adjustable with respect to said keepers whereby said halter can be sized to fit the desired horse.

2. A halter kit comprising a single continuous length of rope, four rope keepers, a halter ring and a clasp, each of said keepers being adapted for engagement with parallel strands of the rope for preventing relative movement therebetween, said clasp being adapted for mounting on a portion of said rope and for releasable engagement with a headband loop formed in said rope, said halter being formed by securing one end portion of said rope in a pair of spaced keepers to define an upper nose loop between said keepers, a continuing portion of said rope extending from said nose loop through another keeper and then back parallel to itself through said keeper to form a headband loop, a continuing portion of said rope extending from said headband loop through still another keeper, thence through said ring and then back parallel to itself through said last mentioned keeper to form a lower jaw loop including said ring, and a continuing portion of said rope extending from said lower jaw loop through the clasp member and back through said first mentioned keeper to form a lower nose loop, said lower nose loop also extending through said halter ring; said headband loop being engageable and disengageable with said clasp when the halter is placed about a horse's head with the horse's nose extending between said upper and lower nose loops and said head loop extending around the back of said horse's head.

* * * * *